United States Patent [19]

Eccleston

[11] 4,042,229

[45] Aug. 16, 1977

[54] TUNDISH WITH WEIRS

[75] Inventor: Kenneth Thomas Eccleston, Birmingham, England

[73] Assignee: Foseco Trading A.G., Chur, Switzerland

[21] Appl. No.: 693,958

[22] Filed: June 8, 1976

[30] Foreign Application Priority Data

June 17, 1975 United Kingdom ..... 25858/75

[51] Int. Cl.[2] ..... C21C 5/00

[52] U.S. Cl. ..... 266/275; 164/82; 266/280

[58] Field of Search ..... 164/82, 281; 222/590–592, 607; 266/165, 236, 275, 276, 280, 283, 284

[56] References Cited

U.S. PATENT DOCUMENTS

| | | | |
|---|---|---|---|
| 260,388 | 7/1882 | Hainsworth | 222/607 |
| 3,521,698 | 7/1970 | Colombo | 222/607 |
| 3,831,659 | 8/1974 | Gerding et al. | 164/281 |
| 3,840,062 | 10/1974 | Kenney | 164/82 |
| 3,887,171 | 6/1975 | Neuhaus | 164/281 |
| 3,917,110 | 11/1975 | Kiguchi | 266/280 |

*Primary Examiner*—Gerald A. Dost

*Attorney, Agent, or Firm*—Cushman, Darby & Cushman

[57] ABSTRACT

The invention provides a tundish comprising a casing having a floor, including an impact area, and upstanding sidewalls, the casing having a permanent refractory lining, and at least one expendable beam of refractory heat insulating material extending between opposite sides of the casing adjacent the impact area. Generally the refractory heat insulating material is one comprising a major proportion of particulate refractory, a minor proportion of fibrous material and an organic binder. In the tundish there may be two pairs of said beams to bridge opposite sides of the casing, one pair being located at the sides of the impact area in or on the floor of the casing and the other vertically above the first, adjacent the top of each sidewall.

9 Claims, 4 Drawing Figures

TUNDISH WITH WEIRS

Figure 1:
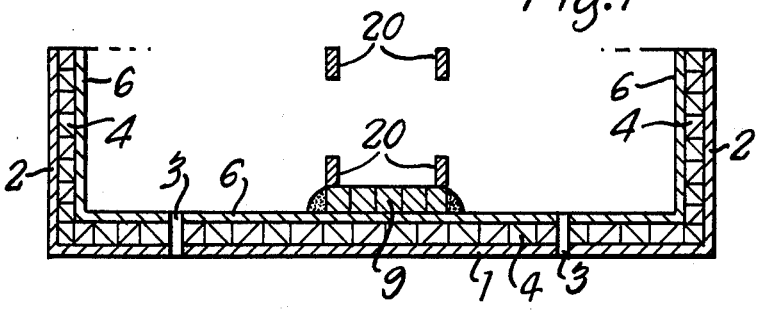

This invention relates to a tundish of the type used in continuous casting of metals, typically steel. The tundish is interposed between a ladle and a mould, and acts as a constant head reservoir. The tundish typically is a casing having a floor and sidewalls, pouring nozzles being located in the floor for egress of the molten metal. The inside of the casing is permanently lined with refractory brick or monolithic refractory, and the impact area of the floor, on which the stream of molten metal from the ladle falls may also have a protective lining. As described in British Patent Specification No. 1,364,655 the casing may also have a further inner expendable lining for the sidewalls and floor, which in use contacts the molten metal, the further lining comprising preformed slabs of refractory heat insulating material, and the impact area of the tundish is lined additionally with highly erosion resistant material or with sacrificial material.

It is an object of this invention to provide a tundish the performance of which is enhanced by minimising splash of molten metal when it enters the tundish from the ladle so reducing the building up of a metal skull.

According to the invention there is provided a tundish comprising a casing having a floor, including an impact area, and upstanding sidewalls, the casing having a permanent refractory lining, and at least one expendable beam of refractory heat insulating material extending between opposite sides of the casing adjacent the impact area.

By the term "expendable beam" is meant a beam which in use is at least partially consumed and which must be replaced each time the tundish is emptied of molten metal. The at least one expendable beam is made from refractory heat insulating material of low thermal conductivity and low thermal capacity.

Preferably two pairs of said beams bridge opposite sides of the casing, one pair being located at the sides of the impact area in or on the floor of the casing and the other vertically above the first, adjacent the top of each sidewall. In use the lower beams act as weirs and confine metal entering the tundish to provide a reservoir or pool of molten metal into which the steam of metal can then fall, so reducing wear on the impact area. The upper beams can also act as weirs, with the lower edge of the upper beams being positioned at the desired constant level of the molten metal in the tundish during use. It is customary to place a heat insulating powder on top of the molten metal in the tundish during continuous casting and the upper beams can prevent the powder from entering the stream of molten metal descending from the ladle. In these ways, splash of molten metal, wear of the impact area, and formation of skull can be reduced.

Generally the beams may be made of a material comprising a major proportion of particulate refractory, a minor proportion of inorganic and/or organic fibrous material and an organic binder, typically a resin binder. Preferably such a material will include (by weight) 75 to 90% refractory, up to 15% fibre and up to 10% binder, and preferably will have a density of 0.8 to 1.5 g/cm$^3$ and a thermal conductivity of less than 0.0007 c.g.s. units.

Suitable materials are those comprising:

Refractory: Silica e.g. silica sand or silica flour, alumina, magnesia, refractory silicates such as aluminium or magnegium silicates and/or carbonaceous materials such as graphite or crushed electrode scrap.

Fibre: Asbestos, calcium silicate e.g. slag wool, aluminium silicate and/or cellulose fibres e.g. paper.

Binder: Starch, phenol-formaldehyde resin and/or urea-formaldehyde resin.

By way of example the beams may be formed of a mixture of the following ingredients in parts by weight:

| | |
|---|---|
| silica sand | 40 to 45 |
| silica flour | 40 to 45 |
| slag wool | 2 to 6 |
| resin binder | 3 to 9 |
| paper | 2 to 6 |

To form a beam the above mixture can be slurried with water and the aqueous slurry drawn onto a perforated former to define a beam, which is then dried and stoved in known manner. In an example the formed beam had a density of 1 to 1.2 g/cc.

The invention includes a method of continuously casting a metal, preferably steel, in which a tundish according to the present invention is used.

Figure 3:
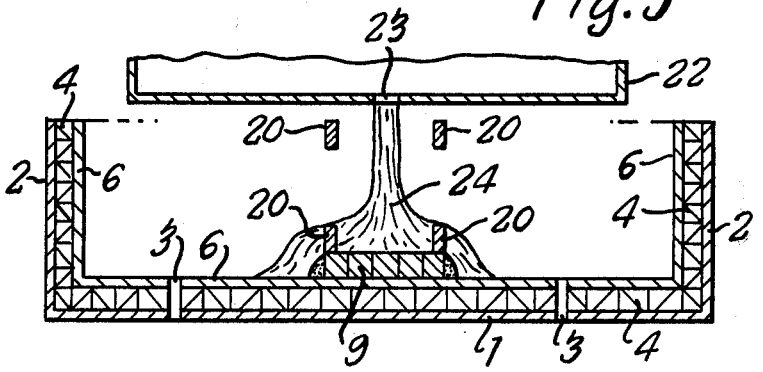
Figure 4:
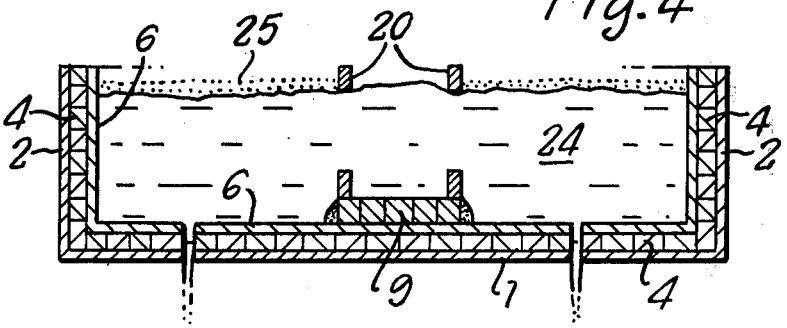
Figure 2:
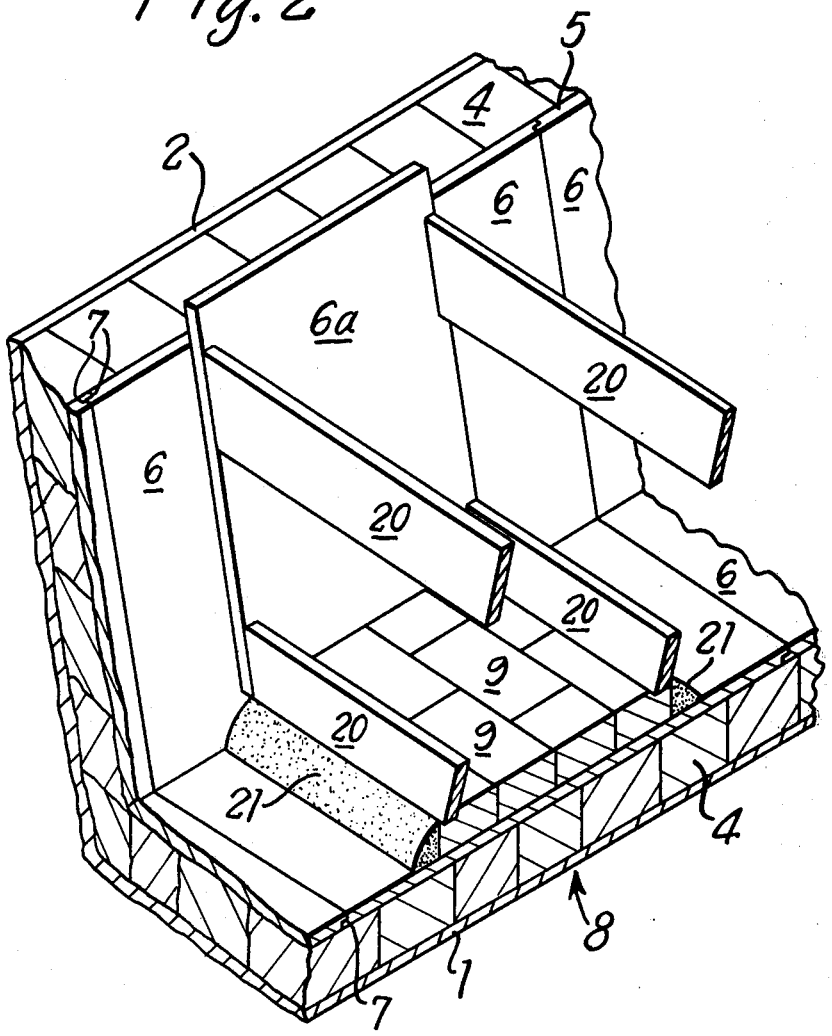

An embodiment of the invention is illustrated in the accompanying drawings, in which FIG. 1 is a sectional view of a tundish;

FIG. 2 is a perspective view from above of the tundish of FIG. 1, drawn to an enlarged scale, parts being cut away; and FIGS. 3 and 4 show successive stages of pouring a stream of molten metal from a ladle into the tundish of FIG. 1.

The tundish shown comprises a metal casing formed of a floor 1 and integral upstanding sidewalls 2. Pouring nozzles 3 are located in the floor 1. As shown in FIG. 2, the casing has an inner permanent lining 4 of refractory bricks, and these are covered by an expendable lining 5 of preformed slabs 6 of refractory heat insulating material having a high heat insulation property and a low thermal capacity. The slabs 6 are interlocked together by rebated edges 7. An impact area 8 for the metal to be poured into the tundish is located on the floor 1 and is covered by refractory bricks 9 for added protection against the erosive effect of the metal. A preformed slab **6*a* (only one shown) is located on each of two opposite sides of the impact area 8 and these slabs 6*a* are wedged apart by expendable beams 20 located in pairs at the bottom of the slabs and adjacent the top. The beams may be held securely in the desired positions in any convenient way, and are formed of refractory heat insulating material of low thermal conductivity and low thermal capacity. The sides of the bricks 9 adjacent the impact area 8 are covered by a step of refractory cement 21**.

In use, the tundish is located below a ladle 22 with the impact area 8 below the outlet 23 of the ladle. Molten steel 24 then flows from the outlet 23 onto the impact area 8, the lower beams 20 tending to confine the flow of metal to the impact area, so minimising splash of the molten metal and forming a reservoir or pool of metal over the bricks 9. The lower beams 20 also act at first as a weir until sufficient metal has been poured in to overflow these beams (as shown in FIG. 3). As the metal rises, it reaches the lower edge of the upper beams 20. Then, heat insulating powder 25 is applied to the surface of the molten metal between the upper beams 20 and the ends of the tundish. Beams 20 thereafter act as weirs tending to prevent movement of the layer of powder 25 into the flow of molten metal from the ladle. Beams 20 also serve to confine the formation of a skull in areas not covered by the layer 25. The beams 20 also have the supplementary effect of holding the slabs 6*a* in position.

The beams may be of any desired shape or size and the upper beams may extend beyond the top of the tundish wall.

If desired the tundish of this invention can incorporate a partition located adjacent one or each outlet nozzle as described in co-pending U.S. Application Ser. No. 693,959 filed June 8, 1976.

I claim:

1. A tundish comprising a casing having a floor including an impact area and upstanding sidewalls including two sidewalls at either end of said impact area;

a permanent refractory lining for said casing;

a pair of expendable preformed slabs of refractory heat- insulating material disposed on said two sidewalls at either end of said impact area, means for providing a weir at said impact area and for supporting said preformed expendable slabs to hold them on said two sidewalls, said means comprising at least one expendable beam of refractory heat insulating material extending between opposite sides of said casing adjacent said impact area and abutting each of said preformed slabs.

2. A tundish according to claim 1, wherein the at least one beam is made of a material comprising a major proportion of particulate refractory, a minor proportion of fibrous material and an organic binder.

3. A tundish according to claim 1, wherein the at least one beam is made of a material comprising by weight 75 to 90% partiuclate refractory, up to 15% fibrous material and up to 10% organic binder.

4. A tundish according to claim 1, wherein the at least one beam is made of a material having a density of 0.8 to 1.5 g/cm$^3$ and a thermal conductivity of less than 0.0007 c.g.s. units.

5. A tundish according to claim 1, wherein the at least one beam is made of a mixture of the following ingredients in parts by weight:

| | |
|---|---|
| silica sand | 40 to 45 |
| silica flour | 40 to 45 |
| slag wool | 2 to 6 |
| resin binder | 3 to 9 |
| paper | 2 to 6. |

6. A tundish as recited in claim 1 wherein two parallel, spaced beams are provided adjacent said impact area and abutting said preformed slabs, and further comprising means for preventing movement of powder applied to the surface of molten metal disposed in said casing into the area defined by ,an upward projection of said impact area to the level of said molten metal, and for supporting said preformed expendable slabs to hold them on said two sidewalls, said means comprising a second pair of parallel, spaced beams disposed above said two parallel spaced beams and extending between opposite sides of said casing straddling the upward projection of said impact area and in abutting engagement with top portions of said preformed slabs.

7. A tundish as recited in claim 1 further comprising an additional lining for said impact area, said lining formed of a material selected from the group consisting of highly erosion resistant and sacrificial materials.

8. A method of continuously casting metal in a tundish including a casing having the walls thereof lined with refractory material and having a floor including an impact area, with a first pair of spaced parallel beams on said floor adjacent said impact area, said method comprising the steps of pouring molten metal in a flow between said spaced first pair of beams to impact said impact area, continuing pouring of said molten metal in a flow until the level of molten metal in said casing reaches a predetermined vertical level, applying insulating powder to the surface of the molten metal in said casing at said predetermined level, and preventing the movement of powder into the flow of molten metal into the casing and confining formation of a skull in areas of said molten metal surface not covered by said insulating powder.

9. A method as recited in claim 8 wherein said step of confining the movement of powder into the flow of molten metal into the casing and confining formation of a skull in areas of said molten metal surface not covered by said insulting powder is accomplished by providing a second pair of parallel spaced beams disposed vertically above said first pair of beams and straddling a vertical projection of said impact area and thereby straddling said molten metal pouring flow, and wherein said step of continuing pouring is effected until the molten metal in said casing reaches the vertical level of said second pair of beams, and wherein said level is substantially maintained by continuous pouring.

* * * * *